US006354114B1

(12) United States Patent
Sghiatti

(10) Patent No.: US 6,354,114 B1
(45) Date of Patent: Mar. 12, 2002

(54) PROTECTIVE SOCK AND ITS ASSOCIATED METHOD OF MANUFACTURE

(76) Inventor: Julius S. Sghiatti, 315 W Riverswoods Dr., New Hope, PA (US) 18938

( * ) Notice: Subject to any disclaimer, the term of this patent is extended or adjusted under 35 U.S.C. 154(b) by 0 days.

(21) Appl. No.: 09/637,207

(22) Filed: Aug. 14, 2000

(51) Int. Cl.[7] ..... A41B 11/00; A43B 17/00

(52) U.S. Cl. ..... 66/178 R; 2/239

(58) Field of Search ..... 66/176, 194, 188, 66/172 R, 178 R, 172 E, 171; 2/239

(56) References Cited

U.S. PATENT DOCUMENTS 743,625 A * 11/1903 Douglas ..... 66/180
2,578,895 A * 12/1951 Meengs et al. ..... 66/180
2,926,512 A * 3/1960 Robertson ..... 66/180
3,039,282 A * 6/1962 Hayes ..... 66/180
4,034,580 A * 7/1977 Holder ..... 66/172 E
4,513,589 A * 4/1985 Kearns ..... 66/180
4,961,235 A * 10/1990 Williger ..... 2/239
5,428,975 A * 7/1995 Lee, III et al. ..... 66/178 R
5,675,992 A * 10/1997 Wrightenberry ..... 66/178 R

* cited by examiner

*Primary Examiner*—Danny Worrell
(74) *Attorney, Agent, or Firm*—LaMorte & Associates

(57) ABSTRACT

A sock and its associated method of manufacture. The sock is a knit sock, knit as a continuous tubular structure from a closed toe end to an open top end. At some point between the closed toe end of the sock and the open top end of the sock, at least a four inch section of the tubular structure is sewn from a combination of yarns that contain elastic. After the tubular structure is knit, the top end and the bottom end of the central elastic section are folded together and joined along a common seam. As the top end and the bottom end of the central elastic section are joined together, the material of the central elastic section loops over and radially extends as a flare from the tubular structure of the sock. The flare is made from the combination of yarns that include elastic. As such, the flare has elastic properties and can be stretched over the open top of a shoe. Once pulled over the shoe, the flare of the sock prevents foreign material from getting into the shoe in between the sock and the shoe.

8 Claims, 3 Drawing Sheets

PROTECTIVE SOCK AND ITS ASSOCIATED METHOD OF MANUFACTURE

BACKGROUND OF THE INVENTION

1. Field of the Invention

In general, the present invention relates to the structure of socks and the manufacturing techniques used to manufacture socks. More particularly, the present invention relates to socks that overlap the shoe about the ankle, thereby preventing debris from entering the shoe between the shoe and the sock.

2. Description of the Prior Art

Socks are made in many different styles using many different manufacturing techniques. However, the purpose of the sock remains the same. A sock serves as a protective barrier between the skin of the foot and the material of the shoe. The sock cushions the foot within the structure of a shoe and absorbs sweat produced by the foot. As such, the use of socks greatly increases the comfort associated with wearing shoes and prevents shoes from becoming contaminated and damaged by the excretions produced by the skin of the foot.

Shoes also come in many different styles. Different shoes extend to different points on the foot or leg. Some shoes terminate below the ankle. Some shoes terminate at the ankle. Still other shoes, typically boots, terminate at some point above the ankle on the leg. Socks are typically selected to be higher than the shoe that is being worn. As a result, the sock prevents any portion of the shoe from contacting the leg, thereby increasing comfort.

Socks are typically made of knitted material that provides the structure of the sock with some degree of elasticity. As such, when a sock is worn, the sock conforms to the contour of the foot and leg. However, shoes are typically not made from elastic materials. As such, shoes are fitted to the foot and gaps inevitably exist between the shoe and the socked foot at various locations. One point where the gap between the shoe and the socked foot is most prevalent is at the opening of the shoe where the socked foot enters the shoe. This opening typically is located near the ankle.

When a person walks, the gap between the shoe and the socked foot varies as the foot and shoe move in relation to each other. When a person is walking through loose material, such as dirt, snow, sawdust, mud, tall grass and the like, it is not uncommon for such loose material to enter the gap that exists between the shoe and the socked foot. Once such debris enters the gap, the debris passes down into the shoe and becomes wedged between the shoe and the socked foot. If the debris is solid, such as gravel, wood chips, dirt or the like, the presence of the debris makes the wearing of the shoe uncomfortable. The shoe must then be removed and the debris removed. If the debris that enters the shoe is water, snow or the like, then the sock becomes wet and uncomfortable. The shoe and sock must then be removed and the sock must be dried or replaced.

In the prior art there have been many different types of garments that have been designed to help prevent foreign material from entering the gap that exists between a shoe and a socked foot. One type of garment that exists is a sock having a flare just above the point where the sock extends above the shoe. The flare is sewn onto the sock and can be folded down over the open top of the shoe, thereby covering the gap that exists between the shoe and the socked foot. Such prior art socks are exemplified by U.S. Pat. No. 5,682,616, to Pisano, entitled, Protective Sleeve For Preventing Debris Intrusion.

Prior art socks that have protective flares have traditionally been made by taking an ordinary sock and sewing a flare onto the sock at the appropriate point. Since the sock is made from two different sections of material, the sock cannot be manufactured in an automated process on a single sock knitting machine. Rather, such prior art socks have to be manufactured in a multiple step procedure that involves the alignment of the flare onto the base sock and the sewing of the flare onto the base sock. Accordingly, the cost and labor involved in creating flared protective socks make the socks significantly more expensive than traditional socks of the same material.

A need therefore exists for an improved protective sock that can be manufactured at low cost in an automated fashion by a single knitting machine. This need is met by the present invention as it is described and claimed below.

SUMMARY OF THE INVENTION

The present invention is a sock and its associated method of manufacture. The sock is a knit sock that is knit as a continuous tubular structure from a closed toe end to an open top end. At some point between the closed toe end of the sock and the open top end of the sock, at least a four inch section of the tubular structure is sewn from a combination of yarns that contain elastic. After the tubular structure is knit, the top end and the bottom end of this central elastic section are folded together and joined along a common seam. As the top end and the bottom end of the central elastic section are joined together, the material of the central elastic section loops over and radially extends as a flare from the tubular structure of the sock. The flare is made from the combination of yarns that include elastic. As such, the flare has elastic properties that enable it to be stretched over the open top of a shoe. Once pulled over the shoe, the flare of the sock prevents foreign material from getting into the shoe in between the sock and the shoe.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention protective sock can be manufactured in any size for use with most any size of shoe or boot, the present invention protective sock is particularly well suited for use with work boots that pass over the top of the ankle. Accordingly, the illustrated examples of the present invention sock will show applications where the present invention sock is sized to be worn with a traditional work boot.

Figure 1:
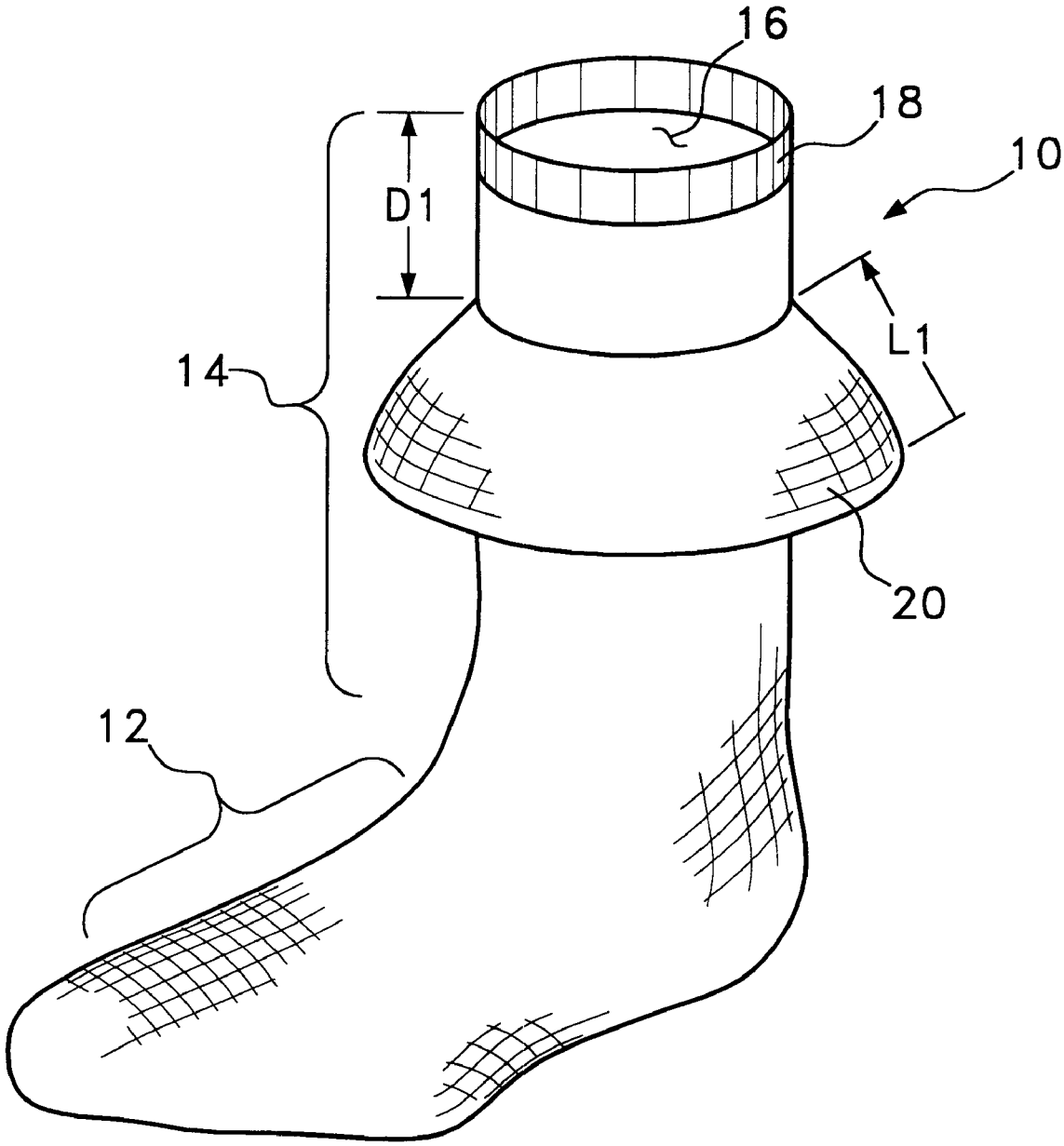
FIG. 1 is a perspective view of an exemplary embodiment of a sock in accordance with the present invention.

Referring to FIG. 1, a sock 10 is shown in accordance with the present invention. The sock 10 is manufactured on an automated knitting machine, as a single piece, as will later be explained. The sock 10 has a foot section 12 that covers the foot. The foot section 12 is traditional in form and begins with a closed toe. The foot section 12 leads into the leg section 14 of the sock 10. The leg section 14 of the sock 10 is the section of the sock 10 that extends vertically over the ankle and onto the leg of the person wearing the sock 10. The leg section 14 of the sock 10 terminates at an open top end 16. It is the open top end 16 through which a person passes his/her foot when putting on the sock 10. The area 18 immediately proximate the open top end 16 may contain elastic, as is traditional in many sock designs.

A flare 20 is present on the leg section 14 of the sock 10. The flare begins at a predetermined distance D1 below the open top end D1 of the sock 10. This same point can also be referenced as being a second distance from the closed toe end of the sock 10. The flare 20 has a radial length L1, which is preferably between two inches and eight inches. The combination of yarns or threads used in the flare 20 need not be the same as the combination of yarns or threads used in the foot section 12 of the sock 10 or the remainder of the leg section 14 of the sock 10. The combination of yarns and threads used in the flare 20 preferably includes elastic so that the flare 20 itself embodies a fair amount of elasticity when stretched. The flare 20 of the sock 10 is the portion of the sock 10 that folds down over the top of a shoe or a boot, thereby preventing foreign material from entering the shoe. Although the material of the flare may differ from the rest of the sock, the flare 20 is still manufactured in a single piece as part of the sock 10.

Figure 2:
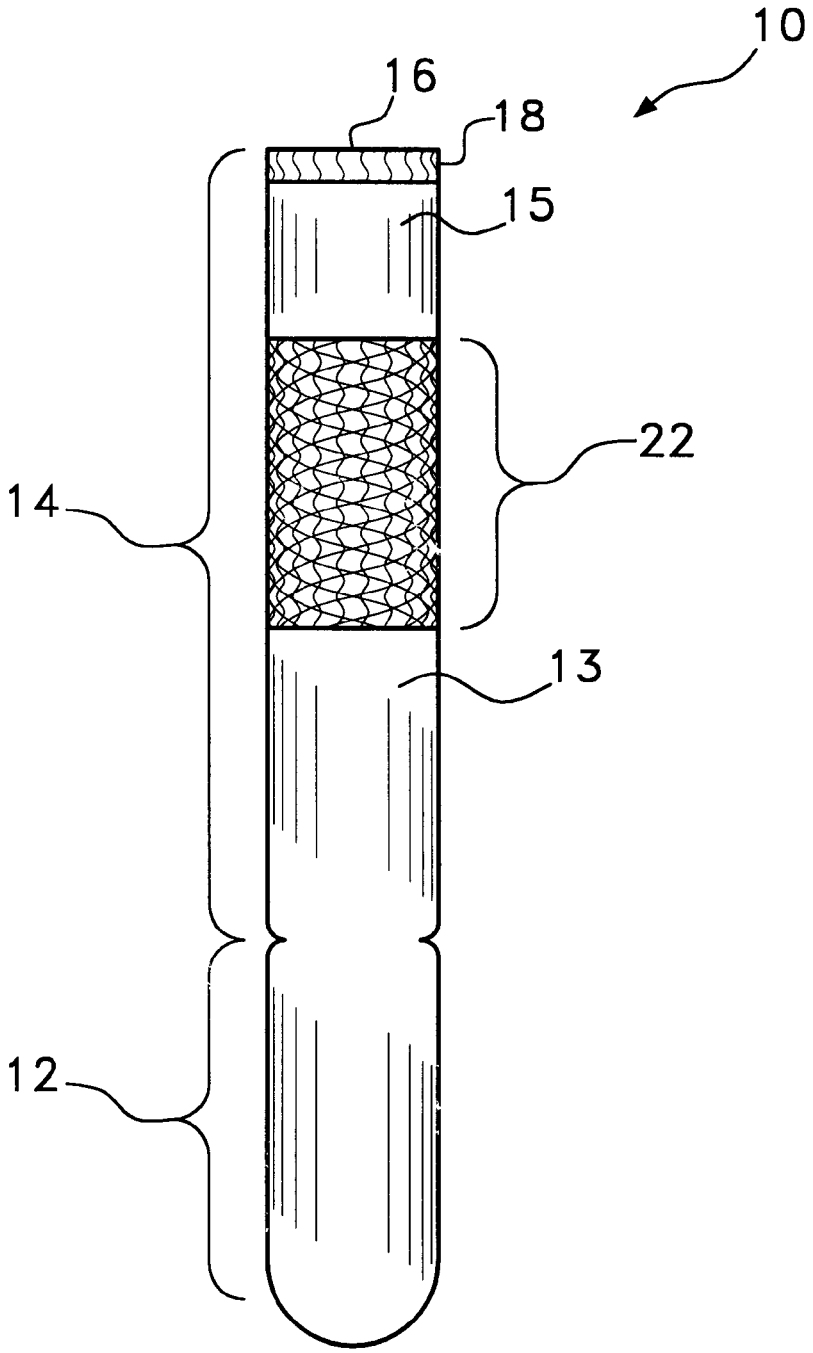
FIG. 2 is a front view of a knit tubular structure that forms the embodiment of the sock shown in FIG. 1.

Referring to FIG. 2, it can be seen that the sock 10 is knit as a single unistructural unit. The foot section 12 of the sock 10 is knit in a first combination of yarns or threads using a first knitting pattern. For example, the foot section 12 of the sock 10 may be knit of 100% cotton yarn and can be knit with a large looped pattern so that the interior of the sock 10 is plush in this area.

The lower portion 13 of the leg section 14 of the sock 10 can be knit in the same yarns and the same knit pattern as the foot section 12 of the sock. However, if desired, the yarns and knit pattern can be altered. For example, if there is a transition from the foot section 12 of the sock to the lower portion 13 of the leg section 14, a small percentage of elastic yarn can be added into the yarns being knitted. The presence of the elastic yarn will add a degree of elasticity to the lower portion 13 of the leg section 14 that is not shared by the foot section 12 of the sock 10.

As the sock 10 is knit, the sock 10 reaches a transition point between the lower portion 13 of the leg section 14 and the section of the sock that produces the flare. At the transition point of the flare section 22, the yarns used in the knitting of the sock 10 are changed to contain over 10% elastic yarn. Furthermore, the color of the yarns being used and the knit pattern can also be altered. The result is a flare section 22 of the sock 10 that has a different color from the remainder of the sock 10 and a higher degree of elasticity than the areas of the leg section 14 of the sock that border the flare section 22.

The length of the flare section 22 is twice as long as the length L1 of the flare 20 (FIG. 1) that is produced in the final sock 10. Since the flare 20 (FIG. 1) is at least two inches long, the flare section 22 knitted into the sock 10 is at least four inches long. At the top edge of the flare section 22 there is another transition, wherein the knitting of the sock changes to that of the upper portion 15 of the leg section 14 of the sock 10. The upper portion 15 of the leg section 14 of the sock 10 can be fabricated from the same yarns as the lower portion 13 of the leg section 14 below the flare section 22. If desired, the upper section 15 can also be made of different types and colored yarns, so as to be distinctive from the lower portion 13 of the leg section 14.

The upper portion 15 of the leg section 14 of the sock 10 extends upwardly to the open top end 16 of the sock 10. If desired, additional elastic yarn can be used in the area 18 of the sock 10 proximate the open top end to create an elastic support band.

As is apparent from FIG. 2, the entire sock 10 can be fabricated as a continuous tubular structure. Although different sections of the sock 10 use different yarns and different knit patterns, such a unistructural knit structure is easily manufactured on a programmable automated knitting machine.

Figure 3:
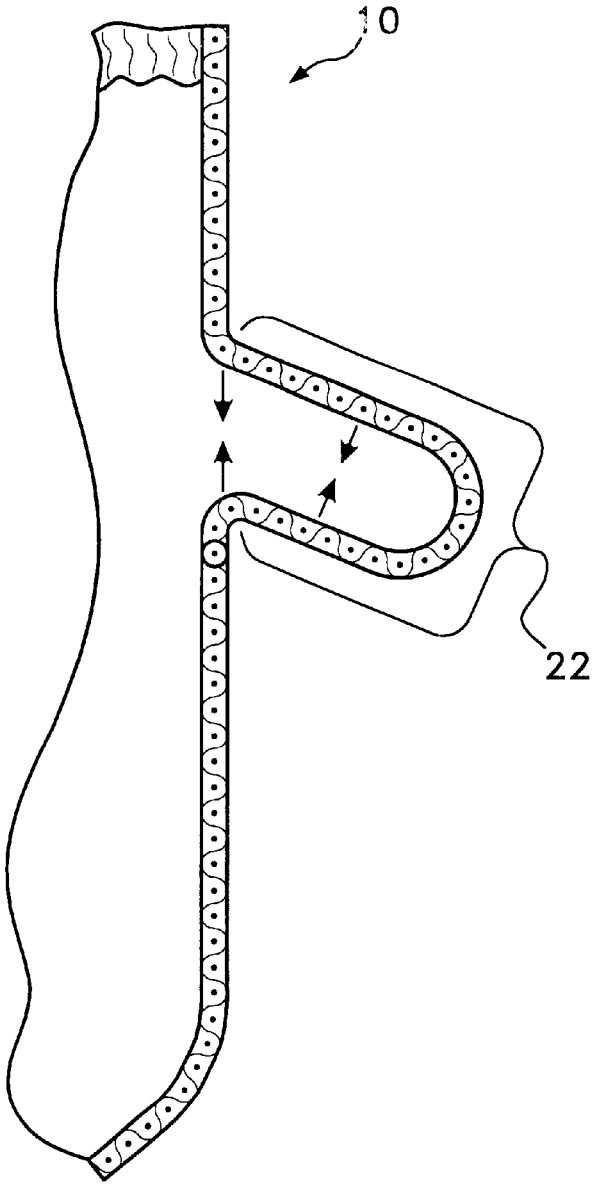
FIG. 3 is a fragmented cross-sectional view of the sock of FIG. 1, shown prior to being sewn closed.

Referring to FIG. 3, it can be seen that the form of the present invention sock 10 is produced when the top edge of the flare section 22 of the sock and the bottom edge of the flare section 22 of the sock are brought together. When the two edges of the flare section 22 are brought together, the flare section 22 of the sock 10 loops over itself, thereby producing the flare 20 (FIG. 1). The length of the resulting flare 20 (FIG. 1) is half the length of the flare section 22.

Figure 4:
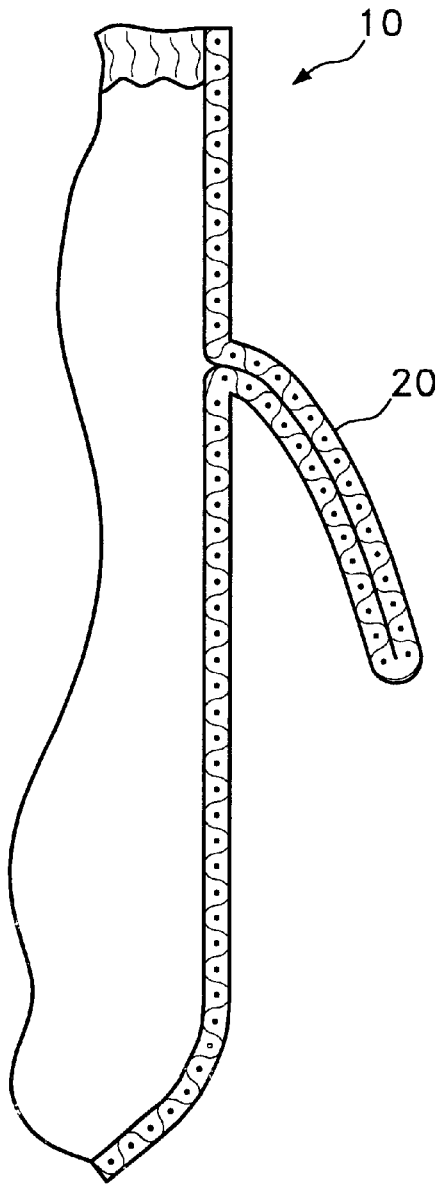
FIG. 4 is a fragmented cross-sectional view of the sock of FIG. 1, shown after being sewn closed.

Referring to FIG. 4, it can be seen that the top edge of the flare section and the bottom edge of the flare section are joined together to form the flare 20. The two edges can be sewn together, knit together or adhesively bonded. Once joined, the sock 10 is complete. The result is a sock 10, such as that shown in FIG. 1 and FIG. 4, wherein a flare 20 extends from the sock. The flare can be a different color and can have differing elastic properties from that of the remainder of the sock.

It will be understood that the embodiment of the present invention sock and method of manufacture described and illustrated herein are merely exemplary and a person skilled in the art can make many variations to the embodiment shown without departing from the scope of the present invention. All such variations, modifications and alternate embodiments are intended to be included within the scope of the present invention as defined by the appended claims.

What is claimed is:

1. A method of manufacturing a sock, comprising the steps of:

knitting a tubular sock structure having a closed toe end and an open top end, said tubular sock structure having, a bottom section that extends from said closed toe end a predetermined distance along said tubular sock structure, a top section that extends from said open top end a predetermined distance along said tubular sock structure, and a flare section interposed between said bottom section and said top section;

wherein said bottom section is knit from a first combination of yams, said flare section is knit from a different second combination of yarns and said top section is knit from a different third combination of yams, thereby providing said bottom section, said flare section and said top section with different physical properties;

joining a first part of said flare section near said bottom section to a second part of said flare section near said top section, thereby creating a looped flare from said flare section that radially extends from the sock.

2. The method according to claim 1, wherein said bottom section of said tubular sock structure is knit with a first knit pattern, said flare section is knit with a different second knit pattern and said top section is knit with a third knit pattern.

3. The method according to claim 1, wherein said bottom section of said tubular sock structure has a first color scheme and said flare section has a second different color scheme.

4. The method according to claim 1, wherein said third knit pattern of said top section is different than said second knit pattern of said flare section.

5. The method according to claim 1, wherein said top section of said tubular sock structure has a third color scheme that is different from said first color scheme and said second color scheme.

6. The method according to claim 1, wherein said step of joining includes knitting said first part of said flare section to said second part of said flare section.

7. The method according to claim 1, wherein said flare extends from said sock at least three inches.

8. The method according to claim 1, wherein said flare is knit from yarns that contain at least 10% elastic by weight.

* * * * *